United States Patent [19]

Knebel

[11] Patent Number: 4,667,987

[45] Date of Patent: May 26, 1987

[54] DEVICE FOR CONNECTING PIPES WITH FITTINGS

[75] Inventor: Werner Knebel, Iserlohn, Fed. Rep. of Germany

[73] Assignee: Knebel & Rottger GmbH & Co., Fed. Rep. of Germany

[21] Appl. No.: 817,265

[22] Filed: Jan. 9, 1986

[30] Foreign Application Priority Data

Jan. 19, 1985 [DE] Fed. Rep. of Germany ..... 3501679

[51] Int. Cl.[4] ..... F16L 39/00

[52] U.S. Cl. ..... 285/137.1; 285/348; 285/354; 285/356; 285/377

[58] Field of Search ..... 285/137.1, 348, 354, 285/356, 377

[56] References Cited

U.S. PATENT DOCUMENTS

| | | | |
|---|---|---|---|
| 3,125,361 | 3/1964 | Weaver | 285/137.1 |
| 3,590,855 | 7/1971 | Woollen et al. | 285/137.1 |
| 4,062,571 | 12/1977 | Sicard | 285/137.1 |
| 4,294,473 | 10/1981 | Ekman | 285/356 |
| 4,319,772 | 3/1982 | Weirich et al. | 285/137.1 |
| 4,382,618 | 5/1983 | Grisebach | 285/137.1 |
| 4,544,185 | 10/1985 | Weirich et al. | 285/137.1 |
| 4,584,723 | 4/1981 | Hussauf | 285/249 |

FOREIGN PATENT DOCUMENTS

| | | | |
|---|---|---|---|
| 0124826 | 7/1947 | Australia | 285/137.1 |

*Primary Examiner*—Richard J. Scanlan, Jr.
*Assistant Examiner*—Douglas W. Hanson
*Attorney, Agent, or Firm*—Jacobs & Jacobs

[57] ABSTRACT

A device for connecting pipes with fittings or fixtures for mixing fluids for use in cleaning, washing and rinsing basins, sinks or the like wherein the fitting has a casing supported over an opening of the washing basin or the like by clamping means capable of being tightened against the underside of a washing table top or the like and water-conducting pipes extending through said opening, the pipes being constructed as connecting conduits capable of being plugged into the pipes and having a collar extending around the conduits at least near their ends to be plugged, and being secured in position by a molded part which can be supported on the casing of the fitting and a clamping device acting on said molded part, so as to be able to dispense with additional sealing elements within the zone of connection of the pipes, the pipes being composed of plastic material with thickened collars molded therearound and having toward the free end of the pipe a sealing surface capable of being clamped against a sealing seat of the casing of the fitting.

10 Claims, 8 Drawing Figures

DEVICE FOR CONNECTING PIPES WITH FITTINGS

In known devices of this type, the casing of the fixture is normally provided with a centering pin fixed in the opening of the washing basin or the like. Furthermore, for connecting the water mains for cold and hot water, short copper pipes are soldered in receiving bores in said centering pin. This arrangement has the serious drawback that only with much difficulty can the connecting pipes be replaced because any such replacement requires new soldering. Additionally, a relatively large space is required for storing and transporting such prefabricated devices because the connecting conduits are normally relatively long and bulky.

According to German published patent disclosure DE-OS No. 32 45 890, which represents the state of the art prior to the present invention, the foregoing disadvantages are avoided by providing the connecting conduits in a form capable of being plugged into the casing of a fitting, and wherein the connecting conduits have a flanged ring thereon shaped by upsetting for axially securing and supporting a sealing gasket. A molded part is provided for axially securing the connecting conduits and for supporting the casing of the fitting. In the direction of the fastening surface of the washing bench, the molded part is provided with an elastic washer which may be made of plastic material. For the purpose of fixing the casing of the fitting and for securing the connecting conduits in their plugged positions in the bores through which said conduits extend, a screw bolt is provided which extends through the casing of the fitting and the molded part and is arranged to be screwed with a nut disposed on the bottom side of the washing basin.

The known device permits some simplification in its manufacture because the connecting pipes need be installed only when the device is set up at the site of installation and connecting pipes can be replaced by new pipes if they have become unusable, for example due to faulty installation. No soldering is required with such replacement. Furthermore, packaging is simplified because the connecting pipes can be packaged and stored separately, so that the packaging of casings for fittings can be kept smaller.

It is, however, a disadvantage of said known devices that for sealing the connecting conduits between a collar extending around the conduit and a corresponding shoulder of the casing, a gasket must be installed within the zone of the bores of the water-conducting ducts in order to permit sealing of the joint.

Based on said state of the art, the present invention is predicated on the solution of the problem of providing a device of the general type specified above with which additional sealing elements within the zone of connection of the pipes may be dispensed with while retaining the advantages previously achieved.

For solving said problem, the present invention provides pipes made of plastic material with collars in the form of relatively massive molded parts having a sealing surface in the direction of the free end of the pipes capable of being clamped against a sealing seat of the casing of the fixture or fitting.

By way of example, the plastic pipes used may have a wall thickness of 2 mm whereas the collars are much thicker and relatively massive parts having about two to three times said pipe wall thickness and of about the same height.

The construction according to the present invention permits a direct sealing by means of the collars, which are tightly and permanently joined with the pipe.

Preferably, the collar and the pipe are unitary, i.e. a one-piece molding.

The replacement of materials, i.e., the use of plastic pipes instead of copper pipes, permits simple shaping of the collars by conventional molding or injection molding in the area of the end of the pipe, and reduces the number of individual parts because the O-ring gasket usually required in prior designs is dispensed with.

In an arrangement comprised of a plurality of pipes, it is preferred that the collars of the pipes be in one piece and disposed parallel to each other.

In said variation, although it does not permit an exchange of individual pipes but only of the total block of pipes, the handling of said embodiment is simple.

According to a preferred embodiment of this invention, the clamping device consists of a screw ring which forces the collar against the corresponding fixture or fitting surface of the casing.

The arrangement of the additional screw ring directly forcing the collar(s) against the corresponding fitting surfaces of the casing of the fixture permits disconnection of said screw connection and thus replacement of the pipes without detaching the casing of the fixture from the cleaning or washing basin, the casing being fastened in position by means of a separate screwed joint.

As a further feature of the invention it is proposed that toward the plug-in end of the pipes, the collars terminate in a conical tapering, such that the corresponding plug openings of the casing of the fitting have complementary conical sealing seat surfaces.

Alternatively and preferably it is provided that the collars have a rectangularly profiled cross-section and thus can be located against a plane surface surrounding each plug opening of the casing.

In addition, the clamping device is preferably a screw ring capable of being screwed together with the plug-in end being in the form of a threaded socket.

It is particularly preferred that the screw ring be provided in the form of a screw cap.

In this way, actuation of the screw ring is significantly facilitated.

Since the screw ring provided for clamping can engage the collar directly only within limited areas so that the sealing may be inadequate in exceptional cases at the points where the clamping ring does not abut the surface of the collar, it is provided as an improvement that a pre-curved intermediate disk be arranged between the clamping device and the pipe collars, said disk having holes through which said pipes can extend.

Said pre-curved intermediate disk also provides for a uniform distribution of fluid forces and complete abutment of the collars after the screw ring or the like has been tightened.

The pre-curvature is provided within the central area of the intermediate disk, so that within said area a higher prestress is achieved due to the arching of the material as contrasted with the area zone directly engaged by the screw ring.

With exceptional loads it may be advantageous if an additional seal is arranged between the collar and the part of the casing against which said collar is intended to rest.

In this variation, it may be advantageous, furthermore, if a retaining disk capable of being arrested in the casing of the fitting is arranged as the clamping device, the retaining disk being perforated in accordance with the number of pipes and their relative positions, whereby said perforations or holes have the extendibility required for rotating the retaining disk.

In the accompanying drawings:

FIG. 1 illustrates partly in section and partly in elevation a side view of the device according to the invention, with the interior of said device being partially exposed;

FIG. 2 similarly illustrates a modification of the invention of FIG. 1;

FIG. 2*a* is a sectional view of a detail of FIG. 2.

FIG. 2*b* is a plan view of the device of FIG. 2;

Figure 1:
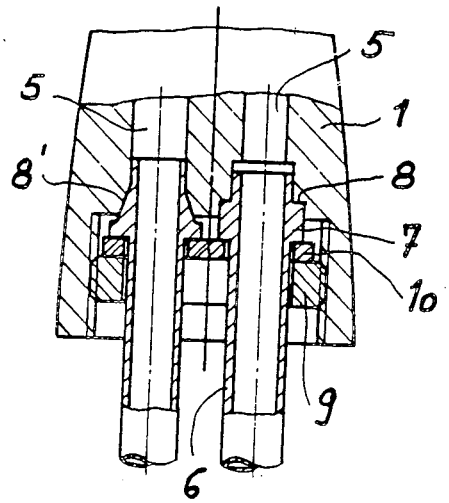
Figure 5A:
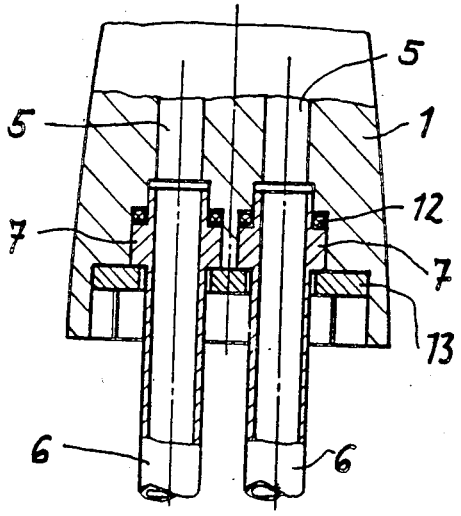

FIG. 5*a* illustrates a still further modification of FIG. 1; and

Figure 5B:
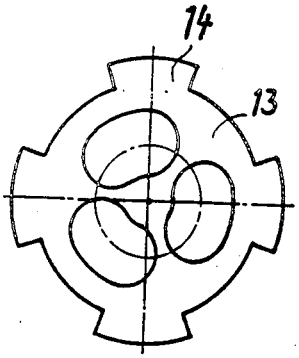

FIG. 5*b* illustrates in plan a detail of the form of the invention of FIG. 5*a*.

Figure 3:
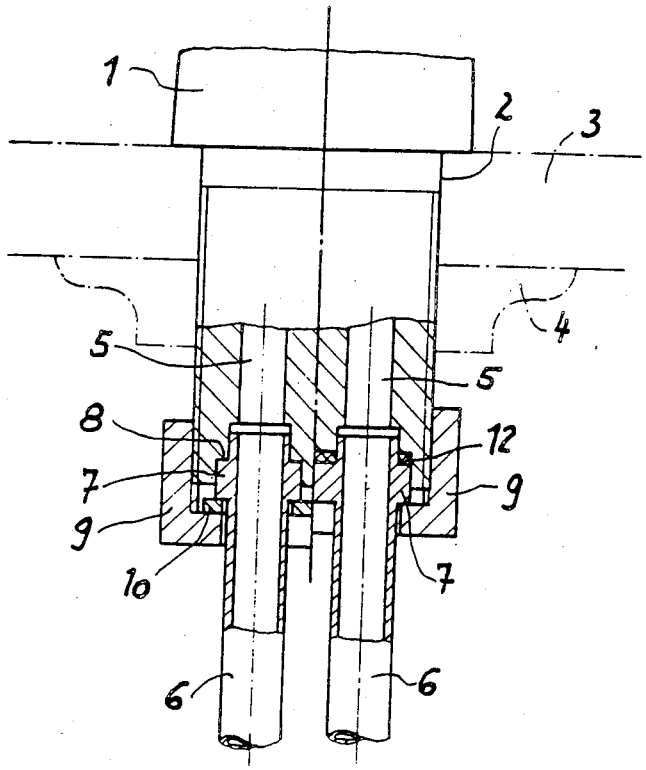
FIG. 3 illustrates a further modification of the structure of FIG. 1.

The present device for connecting pipes with fittings of fixtures is particularly advantageous for connecting conduits for mixing fluids such as hot and cold water for cleaning, washing and rinsing basins, sinks or the like, is substantially comprised of a casing 1 for the fittings and, as will be understood from FIG. 3 in particular, shows clearly that said casing is supported over an opening 2 of a washing basin or sink 3 or the like by support means 4 on the underside of said basin. A number of water-conducting ducts 5 are provided in the casing 1 of the fitting. The pipes 6 function as connecting conduits capable of being plugged into said ducts 5 and are made of any suitable plastic material such as polyethylene with collars 7 disposed adjacent their plug-in ends. The collars 7 are relatively massive thickened molded parts unitary with the pipes 6 and dispensed near one end thereof and the collars 7 have sealing surfaces 8, 8' (as seen in FIG. 1) capable of being clamped against a sealing seat of the casing of the fitting. Clamping is obtained by means of a clamping ring 9 (as seen in FIG. 3) supported in screwable manner on the end of the casing of the fitting. Each unitary pipe 6 and collar 7 is composed of cross-linked polyethylene. As will be seen from FIG. 1, each pipe 6 is provided with a unitary collar 7, thus constituting a single structural element or component.

Figure 2:
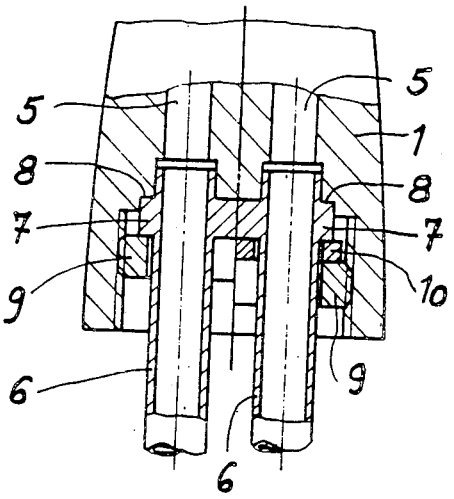

In FIG. 2, the collars 7 of pipes 6 are parallel and the sealing surfaces 8 of the collars 7 are normally planar and horizontal with the area and thus extend transversely of the lengthwise axis of pipes 6. Alternatively, as shown in FIG. 1 at the left-hand side thereof, the collar 8 is conical and tapers toward the direction of the plug-in end of that pipe 6, in which case the corresponding plug opening of the casing 1 is adapted for a conical sealing seat surface.

In the embodiment of FIG. 3, the screw ring 9 is in the form of an inverted screw cap thus permitting particularly easy handling.

Figure 2A:
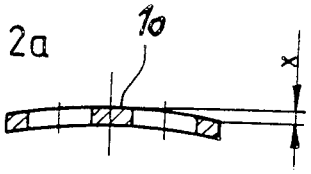
Figure 2B:
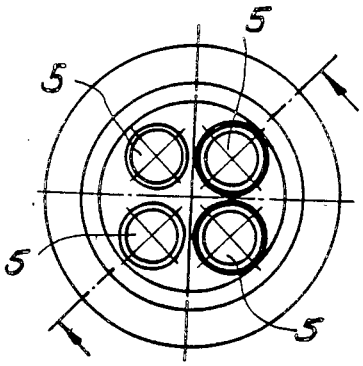

In order to obtain uniform and adequate clamping of the sealing surfaces of the collars 7 against matching sealing surfaces of the casing of the fitting, it is advantageous to provide a pre-curved intermediate disk 10 arranged between the clamping device and the collar 7 of the pipes 6, said intermediate disk having holes or perforations through which the pipes 6 extend. Toward the free end of the pipes 6, the intermediate disk 10 is arched as shown in FIG. 2*a* so that when the clamping device 9 which is in the form of a clamping ring is tightened, a higher prestress is obtained within the area in which the clamping ring 9 does not directly abut.

Figure 4:
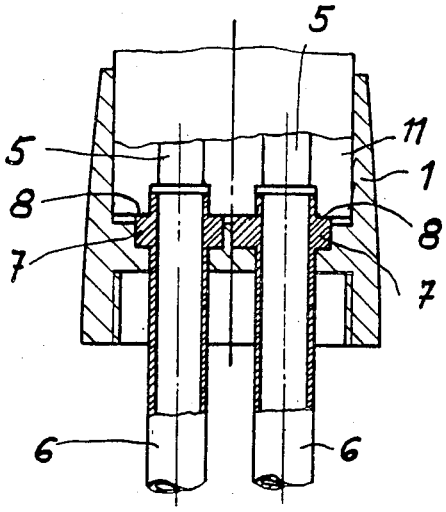
FIG. 4 illustrates a still further modification of FIG. 1.

Normally, the pipes 6 are plugged into the casing of the fitting from the bottom as shown in FIGS. 1, 2, 3 and 5*a*. However, alternatively, the pipes may also be inserted into the casing from the top as shown in FIG. 4. In this embodiment, the collars 7 may be clamped in the same way as in the other embodiments, however, the clamping screw joint is inserted in the casing of the fitting from the top and cooperates with matching courses of threading of the casing.

FIG. 4 shows in principle that the part 11 may be designed in practically the same way as the screw ring 9 of the other embodiments.

The embodiment of FIGS. 5*a* and 5*b* represents a special construction in that said device may be used in cases in which the packing or sealing is expected to meet particularly severe or high operating requirements. In this embodiment, an additional gasket 12 is provided between the sealing surfaces of the collars 7 and the casing 1 of the fitting the same as provided in the embodiment of FIG. 3 at the right-hand side. Furthermore, gasket 12 permits the use of a simple retaining disk 13 instead of the clamping screw joint 9, the disk 13 being perforated in accordance with the number of pipes 6 and the relative position of said pipes, whereby said perforations have the requirements necessary for rotating the retaining disk 13 which has peripherally spaced locking projections 14 (see FIG. 5*b*) capable of engaging matching cuts in the casing of the fitting. A turn of 45 degrees is required for disengaging or engaging said retaining disk.

The present invention thus provides a novel and more efficient device for mixing hot and cold water and other fluids in a water faucet or other fitting or fixture applicable to wash basins, hand basins and kitchen basins for a variety of cleaning and washing operations including hands, textile articles and various household articles such as dishes and cutlery.

The invention is not limited to the foregoing embodimends but may be modified in various ways within the scope of the disclosure and the subjoined claims. All novel individual and combined features disclosed in the specification and/or drawings are deemed to be part of the invention.

What is claimed is:

1. A device for connecting pipes with fittings or fixtures for mixing fluids for use in washing and rinsing basins, sinks or the like, comprising a fitting having a casing supported over an opening of the washing basin or the like, support means on the underside of said basin or sink, conducting ducts extending through said opening, the pipes being constructed as connecting conduits capable of being plugged into said ducts, each of said connecting conduits having a collar extending therearound adjacent its end which is to be plugged in and secured in position by means of a molded part supportable on the casing of the fixture and by a clamping device acting on said molded part, the pipes being composed of plastic material and the collars being relatively massive molded parts located toward the free end of the pipes and a sealing surface capable of being clamped against a sealing seat of the casing of the fixture.

2. A device according to claim 1, wherein each collar and pipe is formed in one piece.

3. A device according to claim 1, wherein the pipes are arranged parallel to each other with a common collar.

4. A device according to claim 1, wherein the clamping device consists of a screw ring which forces the pipe collar against the corresponding fixture surface of the casing.

5. A device according to claim 4, wherein the collars terminate in a conical tapering toward the plugging end of the pipes, and the corresponding plug openings of the casing of the fixture have complementary conical sealing seat surfaces.

6. A device according to claim 1, wherein the collars have a rectangularly profiled cross-section and are capable of being placed against a plane surface surrounding each plug opening of the casing of the fixture.

7. A device according to claim 1, wherein the clamping device is a screw ring capable of being screwed together with the plugging end of the casing of the fixture, said plugging end being a threaded socket.

8. A device according to claim 7, wherein the screw ring is a threaded screw cap.

9. A device according to claim 1, wherein a precurved intermediate disk is disposed between the clamping device and the collars of the pipes, said disk having holes through which the pipes extend.

10. A device according to claim 9, wherein a seal is disposed between the collar and the part of the casing against which said collar can be placed.

* * * * *